United States Patent [19]

Wuchinich

[11] 4,068,149

[45] Jan. 10, 1978

[54] FLASHER CIRCUIT WITH LOW POWER DRAIN

[75] Inventor: David G. Wuchinich, New York, N.Y.

[73] Assignee: Arthur M. Master, Jr., New York, N.Y.

[21] Appl. No.: 625,852

[22] Filed: Oct. 28, 1975

[51] Int. Cl.[2] ..... H05B 37/00; H05B 39/00; H05B 41/14

[52] U.S. Cl. ..... 315/200 A; 340/81 R; 340/331; 315/200 R

[58] Field of Search ..... 315/200 A, 200 R; 340/331, 81 R, 83; 307/283, 288; 331/111, 113 R

[56] References Cited

U.S. PATENT DOCUMENTS

| | | | |
|---|---|---|---|
| 3,018,473 | 3/1970 | Rogers | 340/331 |
| 3,139,556 | 6/1964 | Grontkowski | 315/200 R |
| 3,803,515 | 4/1974 | Carlson | 315/200 A |
| 3,944,803 | 3/1976 | Chao | 340/331 |

*Primary Examiner*—Saxfield Chatmon, Jr.
*Attorney, Agent, or Firm*—Pennie & Edmonds

[57] ABSTRACT

An electronic circuit for flashing an electric lamp is disclosed which may be fabricated from a small number of components and powered by a low-voltage power source which nevertheless assures that the lamp flashes brightly enough to be prominently visible. The on and off times of the lamp are relatively insensitive to temperature variations.

5 Claims, 3 Drawing Figures

FIG. 1
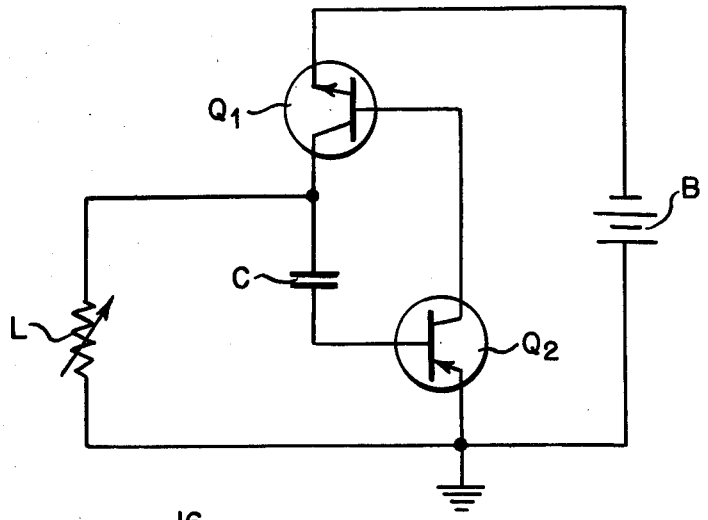
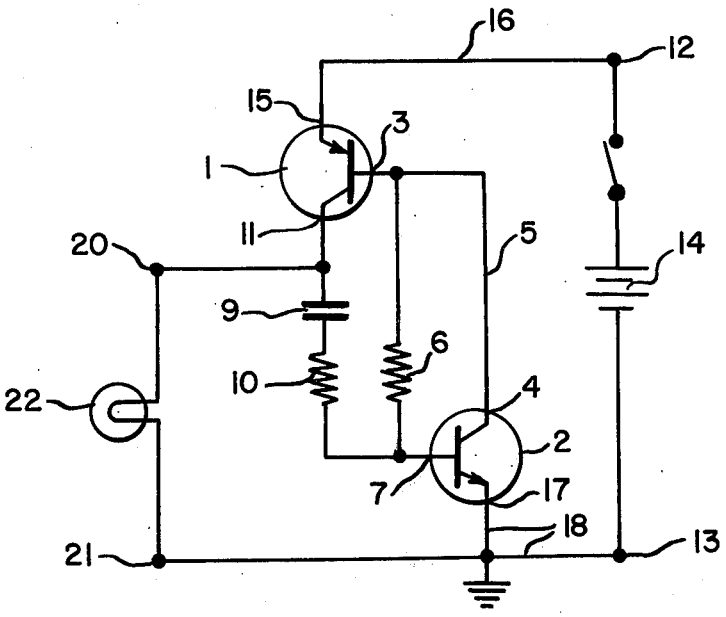
FIG. 2
FIG. 3
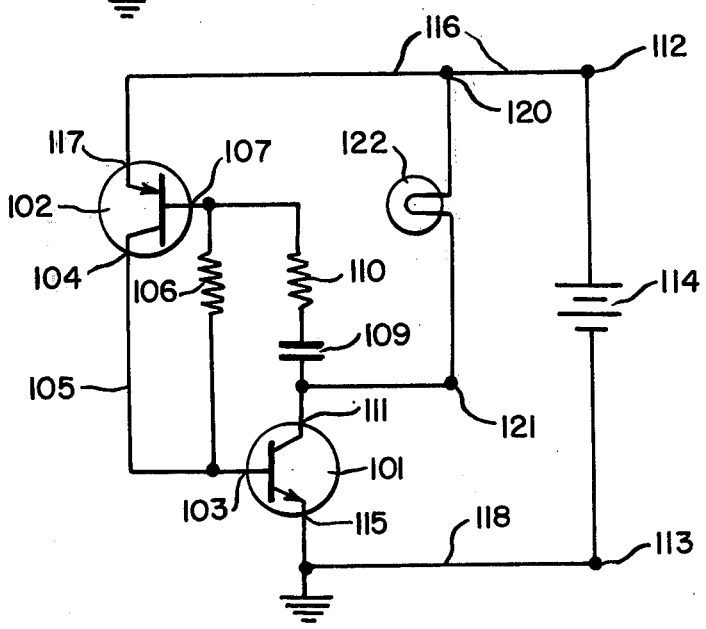

FLASHER CIRCUIT WITH LOW POWER DRAIN

FIELD OF THE INVENTION

The present invention relates to an electronic circuit for periodically energizing an electric lamp, causing the lamp to flash on and off.

BACKGROUND OF THE INVENTION

Low-power electric lights which flash on and off find wide use as signaling devices on boats, bicycles, and road barricades. Frequently the mechanism which causes the light to blink involves a mechanical switch controlled by a bimetallic strip which alternatively heats and cools, thereby closing and opening the switch. The contacts of such switches are often subject to corrosion and pitting, which limits the useful life of the devices. Mechanical switches in flashing signal lamps which must be used out of doors are especially subject to attack by moisture and corrosion. In addition, bimetallic-strip flashers, particularly those adapted for use with low-voltage battery power sources, are so susceptible to jarring and mechanical shocks which can permanently damage flasher action or at very least permanently change the on and off times of the flasher. The on and off times of such flashers are also sensitive to changes in the ambient temperature.

Transistor circuits which periodically energize a load without using mechanical switches or relays have been known since the early days of transistor technology. FIG. 1 depicts such an electronic circuit which was disclosed in the July 1956 issue of *Radio & Television News.* Transistors Q1 and Q2 and NPN and PNP transistors respectively which are regeneratively interconnected to form a multivibrator circuit. A load resistor L is connected to a battery B through the collector and emitter of transistor Q1. The base of transistor Q1 is connected to the collector of transistor Q2, and the collector of transistor Q1, in addition to being connected to load L, is connected to the base of transistor Q1 across a capacitor C. The two transistors in the circuit turn on and off substantially simultaneously since transistor Q2 controls the base current of transistor Q1.

The multivibrator circuit of FIG. 1 has certain limitations, particularly if modern transistors are substituted for the older transistors recommended in the 1956 reference. The circuit has no provision for insuring that it will start to oscillate when a battery is connected to it, relying on leakage currents through the transistors for starting up. If more modern low-leakage current transistors are used, it is necessary, as is well known and in accordance with accepted procedures, to provide one or more additional current paths for turn-on currents.

A further limitation of the circuit of FIG. 1 is that the on-time of the two transistors, which is the length of time the load is energized, is strongly temperature dependent. The on-time is determined principally by the length of time for capacitor C to become charged through the forward-biased base-emitter junction of transistor Q2. The charging time is determined principally by the size of the capacitor and the magnitude of the limiting base current of transistor Q2. Since the limiting current of a forward-biased base-emitter junction of a transistor is generally strongly temperature dependent, the on-time for this curcuit is very sensitive to temperature changes.

U.S. Pat. No. 3,018,473 to Rodgers discloses a low-voltage transistorized electric light flasher in which a pair of coupled NPN and PNP transistors are employed to energize an electric lamp intermittently. The NPN transistor functions to apply a fluctuating bias to the emitter of the PNP transistor, whose collector and emitter are connected in series between the electric lamp and a battery.

The length of time which the lamp remains on in the circuit of the U.S. Pat. No. 3,018,473 is determined principally by the time it takes a charged capacitor connected directly to the base of the NPN transistor to discharge through the forward-biased base-emitter junction of the transistor. The discharge time of the capacitor and consequently the on-time of the lamp are expected to be strongly dependent on temperature for this circuit as in the case of the circuit of FIG. 1, since the discharge time depends on the limiting current through a forward-biased base-emitter junction of a transistor, which, as noted above, is temperature dependent.

The collector of the NPN transistor in the flasher circuit disclosed in the U.S. Pat. No. 3,018,473 is connected directly to the base of the PNP transistor without any interposed resistance. When the NPN transistor is rendered conducting, current flows through a resistor of relatively low resistance connected between the base and the emitter of the PNP transistor, which lowers the potential on the base of the PNP transistor relative to the emitter, rendering the PNP transistor conducting. The U.S. Pat. No. 3,018,473 teaches that in addition to providing an emitter-base bias voltage the resistor between the emitter and base of the PNP transistor serves to restrain the collector current in the NPN transistor to a relatively weak intensity.

U.S. Pat. No. 3,803,515 to Carlson discloses several electronic flasher circuits which employ two complementary transistors regeneratively interconnected through RC networks. Like the U.S. Pat. No. 3,018,473 discussed above, the U.S. Pat. No. 3,803,515 discloses a flasher circuit including a PNP transistor inserted between a lamp and a battery, an NPN transistor whose collector is connected to the base of the PNP transistor, and an RC network having only two resistors and a capacitor. The lamp is energized when the PNP transistor is rendered conductive, which occurs when the NPN transistor becomes conductive. One of the two resistors is connected in series between the emitter of the NPN transistor and the negative terminal of the battery. The U.S. Pat. No. 3,803,515 teaches that a purpose of this resistor is to limit current flowing through the collector and emitter of the NPN transistor and across the base-emitter junction of the PNP transistor. The on-time of the lamp is determined by the discharge time of the capacitor which is connected directly to the base of the NPN transistor. Unlike the two circuits discussed above, the discharge time of the capacitor is not principally determined by the limiting current of a forward-biased base-emitter junction because the resistor connected to the emitter of the transistor reduces the current across the base-emitter junction to less than its limiting value. Nonetheless the discharge time is strongly temperature dependent since it is roughly proportional to the input impedance of the transistor which, for this circuit configuration, depends on the temperature. As noted above, a strong temperature dependence of the on-time of a flasher lamp is a disadvantage for many applications.

SUMMARY OF THE INVENTION

The present invention relates to electronic flasher circuits employing a first and a second transistor, one transistor being a PNP and the other an NPN. A base of the first transistor is connected directly to a collector of the second transistor by a conductor having substantially no resistance. The base of the first transistor is connected to a base of the second transistor by a resistive element. Connecting the base of the second transistor to a collector of the first transistor are resistive and capacitive elements connected in series. Positive and negative power-source terminals are provided which are adapted for connection to a direct-current electrical power source. Emitters of the PNP and NPN transistors are respectively connected to the positive and negative power-source terminals by conductors having substantially no resistance. First and second lamp terminals are provided which are adapted for connection to an electric lamp and which are respectively connected to the collector of the first transistor and to the emitter of the second transistor.

An advantage of the present invention is that an electronic flasher may be fabricated from relatively few components. For example, preferred embodiments of the invention involve only two complementary transistors, two resistors, and a capacitor. Thus flasher circuits of the present invention may be manufactured economically. Importantly, a reduction in circuit elements of only one resistor in circuits of this type can result in a savings of about 10% in manufacturing costs.

A second advantage of the present invention is that both the on-time and the off-time of the lamp may be determined principally by the time constants of resistors and capacitors connected in series, rendering the circuit relatively insensitive to temperature variations.

A third advantage of flasher circuits of the present invention is that mechanical switches and switch contacts are not required. Embodiments of the flasher circuit for use in hostile environments may be completely encapsulated and thereby protected from moisture and corrosion. Electronic flashers employing the present invention may be used to great advantage in applications in which the flasher must be located out of doors.

Another advantage of the present invention is that the flasher circuit may be powered by a low-voltage direct-current electrical power source such as, for example, two series-connected 1.5 v. Leclanche dry cells, yet can produce a brightly flashing, highly visible light. Bulky six-volt batteries are not required to obtain a bright flash.

BRIEF DESCRIPTION OF THE DRAWINGS

FIG. 1 is a schematic circuit diagram of a prior-art multivibrator circuit discussed above;

FIG. 2 is a schematic circuit diagram of an embodiment of the present invention; and FIG. 3 is a schematic circuit diagram of an alternate embodiment of the present invention.

DETAILED DESCRIPTION OF PREFERRED EMBODIMENTS

Referring now to FIG. 2, a first transistor 1 and a second transistor 2 are of the PNP and NPN types respectively. A base 3 of the transistor 1 is connected to a collector 4 of the transistor 2 by a conductor 5 which has substantially no resistance. A resistor 6 is connected to the base 3 of the first transistor 1 and to a base 7 of the second transistor 2. A capacitor 9 and a resistor 10 are connected in series between the base 7 of the second transistor 2 and a collector 11 of the first transistor 1. The resistors 6 and 10 may be carbon composition resistors, for example. A positive power source terminal 12 and a negative power source terminal 13 are adapted to connect to an electric battery 14. The electric battery 14 series serves as a direct-current electrical power source and may be, for example, two Leclanche dry cells connected in series. A positive terminal of electric battery 14 is connected to the positive power source terminal 12 and a negative terminal of electric battery 14 is connected to the negative power source terminal 13. The positive power source terminal 12 is connected to an emitter 15 of the first transistor 1 by a conductor 16 which has substantially no resistance. Similarly, the negative power source terminal 13 is connected to an emitter 17 of the second transistor 2 by a conductor 18 which has substantially no resistance. A first lamp terminal 20 is connected to the collector 11 of the first transistor 1 and a second lamp terminal 21 is connected to the emitter 17 of the second transistor 2. The lamp terminals 20 and 21 are adapted to connect to an electric lamp 22.

Referring now to FIG. 3, a second embodiment of the present invention is shown. A first transistor 101 and a second transistor 102 are of the NPN and PNP types respectively. A conductor 105 which has substantially no resistance connects a base 103 of the first transistor 101 to a collector 104 of the second transistor 102. A resistor 106 is connected to the base 103 of the first transistor 101 and a base 107 of the second transistor 102. A capacitor 109 and a resistor 110 are connected in series between a collector 111 of the first transistor 101 and the base 107 of the second transistor 102. A positive power source terminal 112 and a negative power source terminal 113 are adapted to connect to an electric battery 114 which serves as a direct-current electrical power source. A positive terminal of the electric battery 114 is connected to the positive power source terminal 112 and a negative terminal of electric battery 114 is connected to the negative power source terminal 113. The positive power source terminal 112 is connected to an emitter 117 of the second transistor 102 by a conductor 116 which has substantially no resistance. Similarly an emitter 115 of the first transistor 101 is connected to the negative power source terminal 113 by a conductor 118 which has substantially no resistance. A first lamp terminal 120 and a second lamp terminal 121 are adapted to connect to an electric lamp 122.

In preferred embodiments of the present invention the current-gain factors $\beta$ of both the PNP and NPN transistors exceed 100, and the collector saturation voltage of the transistor whose collector is connected to the lamp can be reduced to about 0.2 volts or less. This low collector saturation voltage and the lack of resistors in the current loop including the power source, the lamp, and the aforementioned transistor ensure that the lamp will flash brightly even when a 3-volt power source is employed.

In operation, referring to the embodiment of FIG. 2, no currents flow in the circuit and capacitor 9 is discharged before batter 14 is connected to the power source terminals 12 and 13. When the positive and negative terminals of battery 14 are connected to the respective positive and negative power source terminals 12 and 13, a start-up current flows around a loop which includes the base-emitter junction of the PNP transistor 1, the resistor 6, and the base-emitter junction of the NPN transistor 2. By flowing across the base-emitter junctions of transistors 1 and 2, which are initially non-conductive, the start-up current tends to render both transistors conductive. As transistor 2 begins to conduct, the current flow from the base 3 of transistor 1 increases, which causes transistor 1 to become more conductive. As transistor 1 becomes conductive, the potential at its collector, initially at ground, begins to increase, which causes the potential at the point where capacitor 9 and resistor 10 are connected to increase as well. Capacitor 9 thus begins to become charged as current flows through resistor 10 into base 7 of the NPN transistor 2, thereby increasing the conductivity of the NPN transistor 2. Since increasing the conductivity of the NPN transistor 2 causes the conductivity of the PNP transistor 1 to increase, which in turn increases the conductivity of the NPN transistor 2 still further, the two transistors are rapidly and substantially simultaneously switched to a conductive state by the start-up current. When transistor 1 becomes conductive, lamp 22 becomes lit.

Although both transistors 1 and 2 are conductive when lamp 22 is lit, it has been found that it is not necessary to include additional circuit elements to limit the current passing through the transistors when a suitable low-voltage battery, such as a 3-volt battery formed by connecting two Leclanche dry cells in series, is employed. The NPN transistor 2 remains on so long as a sufficiently large current is supplied to its base 7 by the charging of capacitor 9. Thus the on-time of transistor 2 is principally determined by the RC time constant of capacitor 9 and resistor 10 connected in series. Since by choosing suitable components the RC time constant of a resistor and capacitor connected in series may be made relatively insensitive to temperature changes, the on-time of the circuit of FIG. 2 may be made relatively temperature independent.

When the charging current from capacitor 9 drops below the level of base current required to maintain NPN transistor 2 in a conductive state, the conductivity of that transistor decreases, which reduces the base current of the PNP transistor 1, thereby reducing its conductivity. The potential at the collector 11 of transistor 1 begins to drop towards ground potential, which lowers the potential at the point where capacitor 9, now carrying a charge, is connected to resistor 10, which in turn reduces the charging current flowing from the capacitor 9. Thus a reduction in the conductivity of transistor 2 causes the current supplied to its base 7 to be reduced, which reduces its conductivity still further. Transistors 1 and 2 therefore switch to a non-conductive state rapidly and substantially simultaneously, switching off lamp 22.

When PNP transistor 1 becomes non-conductive, its collector 11 drops to ground potential, which causes (a) the connection between the capacitor 9 and resistor 10 and (b) the base 7 of transistor 2 to drop to negative voltages, since capacitor 9 carries a charge. Capacitor 9 then begins to be discharged by a current flowing through resistors 10 and 6, which are connected in series. The source of this discharging current is a current flowing from the base 3 of transistor 1 which is the sum of currents flowing across the base-emitter and base-collector junctions of transistor 1. The values of resistors 6 and 10 may be chosen so that the component of the discharging current flowing across the base-emitter junction of transistor 1 is insufficient to turn that transistor on to the extent necessary to light the lamp 22. Moreover, the negative base emitter bias of transistor 2 prevents the discharging current passing through resistor 6 from flowing into the base 7 of transistor 2 and tending to turn that transistor on.

When the capacitor 9 is discharged, the circuit has returned to its initial state and the cycle repeats itself as described. The value of resistor 6 may be chosen so that the discharge time of capacitor 9 is determined principally by the RC time constant of capacitor 9 connected in series with resistors 10 and 6 and is substantially independent of temperature-dependent parameters of the PNP transistor 1. Thus the off-time of the circuit of FIG. 2, which is principally determined by the discharge time of capacitor 9, may be made relatively insensitive to temperature changes.

The operation of the circuit of FIG. 3 is analogous to that operation of the circuit of FIG. 2 described above.

As will be obvious to those skilled in the art, it will be desirable for many applications to include a switch in series with the power source for turning the flasher on and off. It may be advantageous for some applications to substitute a potentiometer for one of the resistors in the circuit in order to permit the on and off times to be varied. Other modifications of the circuit of the present invention will be apparent to those skilled in the art, within the scope of the invention, which is limited only in accordance with the accompanying claims.

EXAMPLE

The circuit of FIG. 3 may be fabricated using components having the following values and designations:

| | |
|---|---|
| Transistor 101 | 2N2219 |
| Transistor 102 | 2N2905 |
| Battery 114 | 3 volts |
| Resistor 110 | 6.8 kΩ |
| Resistor 106 | 82 kΩ |
| Capacitor 109 | 10 μF, 3wvdc |
| Lamp 122 | No. 14 |

This circuit has an on-time of about 0.2 to 0.3 sec and an off-time of about 0.7 to 0.8 sec.

I claim:

1. An electronic flasher circuit consisting essentially of a. a first transistor and a second transistor, one transistor being a PNP transistor and the other being an NPN transistor;

b. conductive means having substantially no resistance connecting a base of the first transistor to a collector of the second transistor;

c. resistive means connecting the base of the first transistor to a base of the second transistor;

d. means connecting the base of the second transistor to a collector of the first transistor, said means comprising capacitive means and resistive means connected in series;

e. a positive power-source terminal and a negative power-source terminal, said power-source terminals being adapted to connect to a direct-current electrical power source;

f. conductive means having substantially no resistance connecting the positive power-source terminal to an emitter of the PNP transistor;

g. conductive means having substantially no resistance connecting the negative power-source terminal to an emitter of the NPN transistor; and h. a first lamp terminal connected to the collector of the first transistor and a second lamp terminal connected to the emitter of the second transistor, said lamp terminals being adapted to connect to an electric lamp.

2. The electronic flasher circuit of claim 1 further comprising an electric lamp connected between the first and second lamp terminals.

3. The electronic flasher circuit of claim 1 further comprising electric-battery means having a positive terminal and a negative terminal, the positive terminal of the electric-battery means being connected to the positive power-source terminal and the negative terminal of the electric-battery means being connected to the negative power-source terminal.

4. The electronic flasher circuit of claim 3 wherein the electric-battery means comprises two Leclanche dry cells connected in series to form a power source with a voltage of about three volts.

5. An electronic flasher circuit consisting essentially of a. a first transistor and a second transistor, one transistor being a PNP transistor and the other being an NPN transistor;

b. conductive means having substantially no resistance connecting a base of the first transistor to a collector of the second transistor;

c. resistive means connecting the base of the first transistor to a base of the second transistor;

d. means connecting the base of the second transistor to a collector of the first transistor, said means comprising capacitive means and resistive means connected in series;

e. a positive power-source terminal and a negative power-source terminal, said power-source terminals being adapted to connect to a direct-current electrical power source;

f. conductive means having substantially no resistance connecting the positive power-source terminal to an emitter of the PNP transistor;

g. conductive means having substantially no resistance connecting the negative power-source terminal to an emitter of the NPN transistor;

h. a first lamp terminal connected to the collector of the first transistor and a second lamp terminal connected to the emitter of the second transistor, said lamp terminals being adapted to connect to an electric lamp; and i. a switch connected to the circuit for activating and deactivating the flasher circuit.

* * * * *